United States Patent [19]

Yang

[11] Patent Number: 4,984,494

[45] Date of Patent: Jan. 15, 1991

[54] TUNING PEN

[76] Inventor: Ming-Jer Yang, 7F, 58 Kuangming Street, Panchiao Taipei Hsien, Taiwan

[21] Appl. No.: 425,249

[22] Filed: Oct. 23, 1989

[51] Int. Cl.[5] ..... G10G 1/04

[52] U.S. Cl. ..... 84/474; 84/456

[58] Field of Search ..... 84/318, 375, 474, 456; 235/79.5, 87 R

[56] References Cited

U.S. PATENT DOCUMENTS

| | | | |
|---|---|---|---|
| 1,859,524 | 5/1932 | Nicolet | 235/87 R |
| 2,262,818 | 11/1941 | Reese | 235/87 R |
| 2,526,408 | 10/1950 | Posson | 235/79.5 |
| 2,595,153 | 4/1952 | Malmgren | 235/87 R |
| 2,777,636 | 1/1957 | Weiser | 235/87 R |
| 2,792,992 | 5/1957 | Ellison | 235/79.5 |
| 2,958,251 | 11/1960 | Calabro | 84/477 R |
| 3,001,435 | 9/1961 | Duffy et al. | 84/474 |
| 3,123,291 | 3/1964 | Madry | 235/87 R |
| 3,185,016 | 5/1965 | Stinson et al. | 84/474 X |
| 4,371,278 | 2/1983 | Joo | 84/375 X |
| 4,475,433 | 10/1984 | Williamson et al. | 84/318 |

*Primary Examiner*—Lawrence R. Franklin

*Attorney, Agent, or Firm*—Ladas & Parry

[57] ABSTRACT

This invention is a Tuning Pen which can serve as a writing apparatus and tuning device as well as a device for checking notes of the scale corresponding to a specific key signature. According to the present invention, the pen holder which has a tuning flute mounted thereon includes a bigger cylinder which has key signatures printed thereon and is coupled with a smaller cylinder which has the notes of the scale printed thereon and is covered with a revolving sleeve which has an opening made thereon to display the note of the scale printed on the smaller cylinder.

1 Claim, 2 Drawing Sheets

TUNING PEN

BACKGROUND OF THE INVENTION

The present invention relates to a TUNING PEN. A device that can be used as a writing apparatus, a device for tuning musical instruments and for checking musical key and tones of the scale.

When learning how to play a musical instrument one must first learn musical notation, tones of the scale and music key signatures. For a beginner it is rather difficult to memorize this complicated musicology. Further, to play a musical instrument, a tuning device is commonly required to adjust the instrument so that it plays in tone.

1. It is therefore, the main object of the present invention to provide such a TUNING PEN which can be used as a device for tuning musical instruments.

2. It is another object of the present invention to provide such a TUNING PEN which can be used as a writing apparatus.

3. It is still another object of the present invention to provide such a TUNING PEN which can be used for checking musical key signatures and the corresponding tones of the scale.

4. It is yet a further object of the present invention to provide such a TUNING PEN is convenient for personal carriage.

SUMMARY OF THE INVENTION

According to the present invention, the pen holder of the TUNING PEN which has a tuning flute mounted thereon (for use in tuning musical instruments) is included in a bigger cylinder which has key signatures printed thereon and is coupled with a smaller cylinder which has the notes of the scale printed thereon and is covered with a revolving sleeve which has an opening thereon to display the notes of the scale printed on the smaller cylinder.

DETAILED DESCRIPTION OF THE PREFERRED EMBODIMENT

Figure 1:
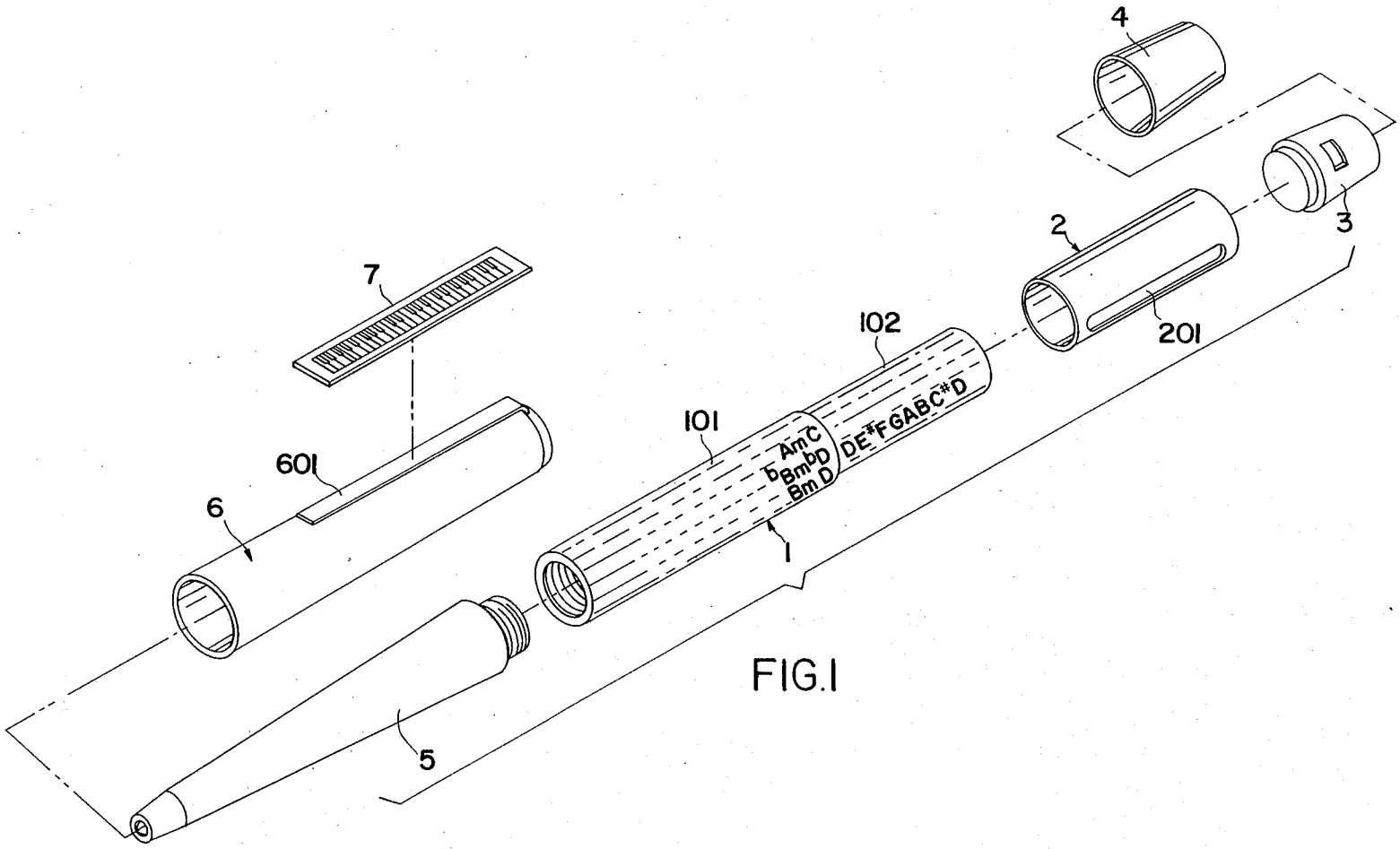
FIG. 1 is a perspective exploded view of the present invention.
Figure 2:
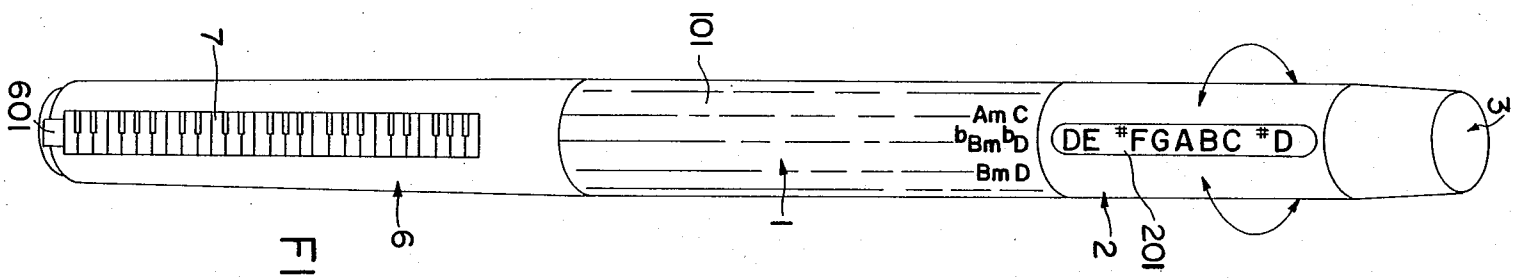
FIG. 2 is a perspective assembly view of the present invention.

Turning now to the detailed drawings, therein illustrated is a TUNING PEN embodying the present invention and generally comprised of a pen holder 1, a sleeve 2, a tuning flute 3, a protective cover 4, a socket 5, a cap 6, and ornament plate 7.

The pen holder 1 is comprised of two cylinders 101 and 102 interlocked with each other by means of a sleeve joint, wherein cylinder 101 has the respective key signatures printed thereon and cylinder 102 has the corresponding notes of the scale printed thereon. The sleeve 2 has an opening 201 made thereon and is revolvably mounted on cylinder 102 to alternatively let the notes of the scale on cylinder 102 be exposed through the opening 201 for reading. The tuning flute 3 is mounted on the sleeve 2 at top is covered by the protective cover 4. The socket 5 is connected to the cylinder 101 by means of a screw joint. The cap 6 is mounted on the socket 5 when the TUNING PEN received and not in use, and includes a clip 601 to which the ornament plate 7 is connected.

When checking notes of the scale, turn sleeve 2 around to allow the key signatures of cylinder 101 to match with cylinder 102, and the notes will be immediately exposed through the opening 201.

According to the present invention, the tuning flute 3 may be removed. From the pen holder 1 for use when providing a standard pitch to tune musical instruments.

I claim:

1. A tuning pen comprising:

a writing implement holder comprising a first cylinder having a larger diameter and a second cylinder having a smaller diameter, said first and second cylinders being connected end-to-end, said first cylinder having musical key signatures indicated around its circumference, said second cylinder having thereon notes corresponding to each musical key signature adjacent to the musical key signature on the first cylinder;

a sleeve having a greater diameter than said second cylinder, said sleeve being coaxial with and rotatable around said second cylinder, said sleeve having an aperture through which the notes corresponding to one musical key signature can be viewed; and a tuning flute which is positioned at one end of said writing implement holder.

* * * * *